United States Patent [19]

Darling

[11] Patent Number: 4,989,624

[45] Date of Patent: Feb. 5, 1991

[54] WETSUIT WASHER

[76] Inventor: Chris F. Darling, 825 Onstoot Rd., Lompoc, Calif. 93436

[21] Appl. No.: 532,872

[22] Filed: Jun. 4, 1990

[51] Int. Cl.[5] ..... B08B 11/02

[52] U.S. Cl. ..... 134/100; 134/167 R; 134/115 R; 134/201

[58] Field of Search ..... 134/166 R, 170, 198, 134/201, 115, 100; 34/106; 223/85, 86, 92; 239/36, 435; 68/205 R

[56] References Cited

U.S. PATENT DOCUMENTS

| | | | |
|---|---|---|---|
| 2,303,313 | 12/1942 | Abbens | 223/86 |
| 2,461,149 | 2/1949 | Ericsons | 223/86 |
| 4,592,497 | 6/1986 | Georges | 223/85 |
| 4,653,295 | 3/1987 | Clifford | 68/205 R |
| 4,949,739 | 8/1990 | Ryan | 134/167 R |

FOREIGN PATENT DOCUMENTS

| | | | |
|---|---|---|---|
| 1261277 | 9/1961 | France | 223/86 |

*Primary Examiner*—Frankie L. Stinson

*Attorney, Agent, or Firm*—Daniel C. McKown

[57] ABSTRACT

A wetsuit washer shaped like a coat hanger, but having a second horizontal member on which the wetsuit is hung, has a hollow construction to permit water to spray from it while the wetsuit is hanging on it. The lower horizontal arm is inside the wetsuit and spray washes that portion of the wetsuit, and the top arm of the coat hanger extends above the shoulders of the wetsuit and directs a spray of water downwardly over the outside of the wetsuit. To prevent excessive splattering, a shroud is placed over the top arm and over the wetsuit. The wetsuit washer does not require a shower chamber, and it can be readily transported and used under field conditions so long as a water hose is available.

8 Claims, 3 Drawing Sheets

Fig. 1
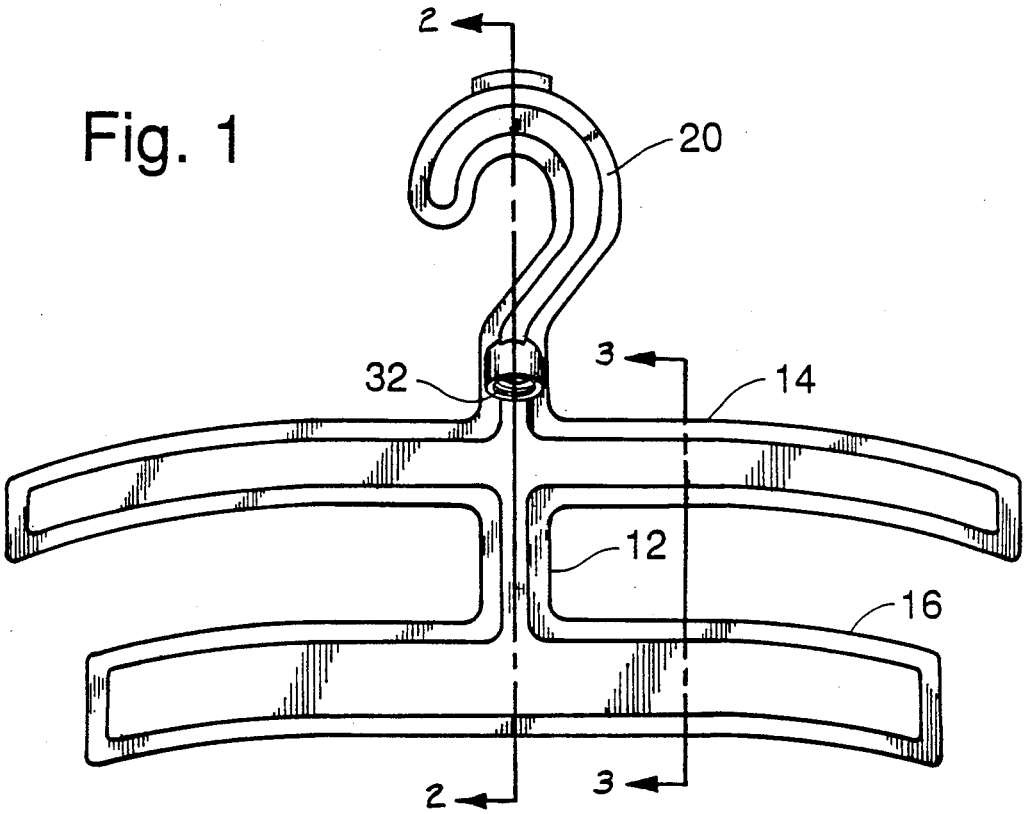
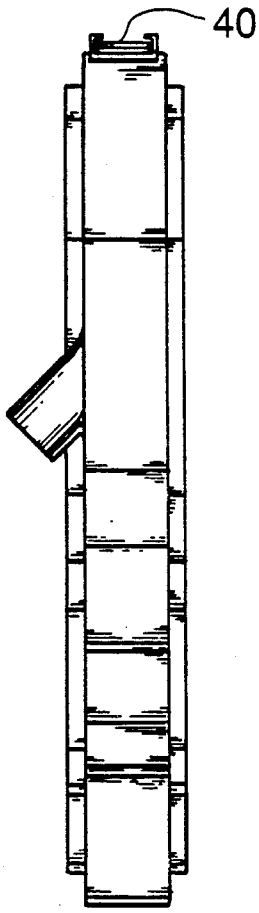
Fig. 7

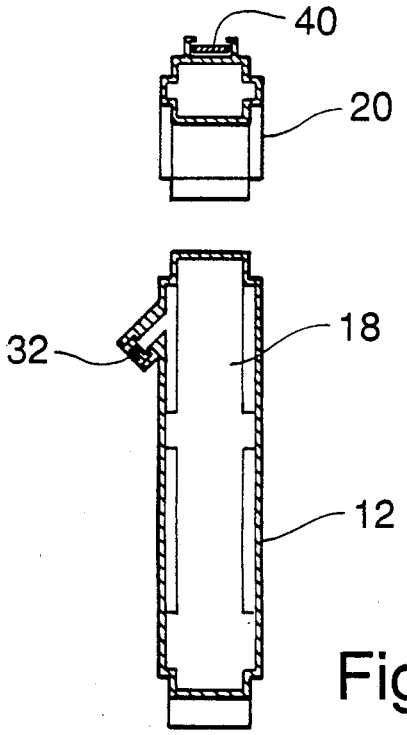
Fig. 2
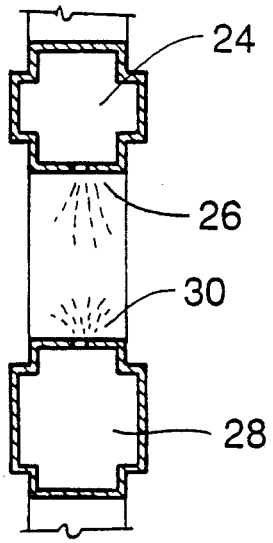
Fig. 3
Fig. 4
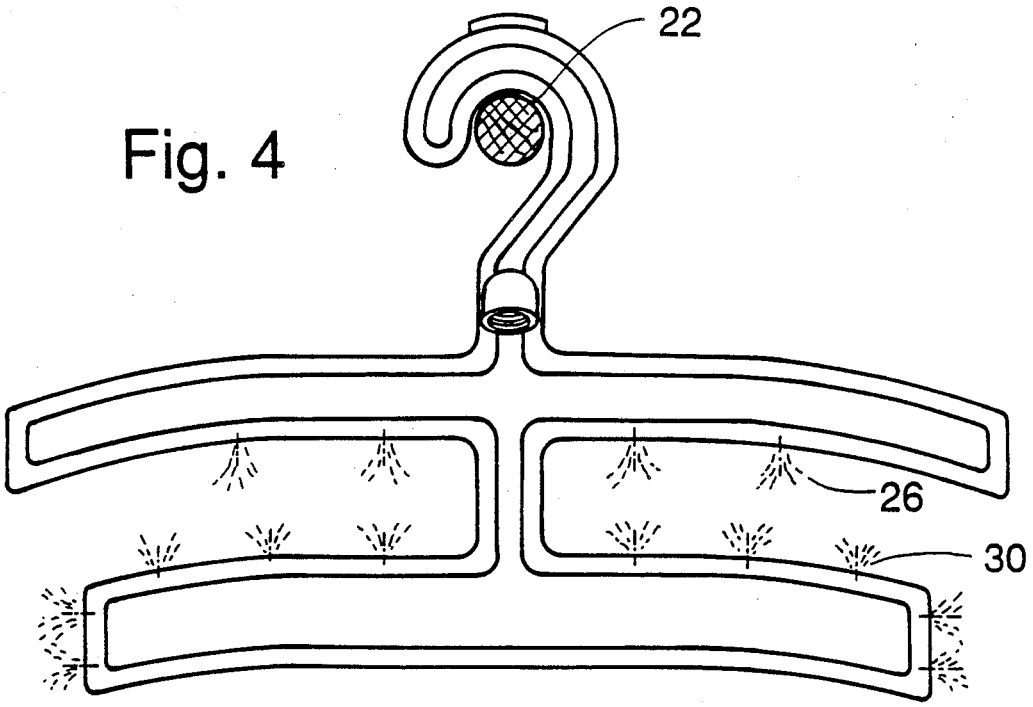

WETSUIT WASHER

BACKGROUND OF THE INVENTION

1. Field of the Invention

This invention relates to a device for washing, rinsing and/or applying a conditioner to a wetsuit or any other non-porous suit, such as suits for fire-fighting and for handling hazardous materials. The suit is hung on the device, which then washes both the inside and outside of the suit.

2. The Prior Art

In U.S. Pat. No. 4,655,235 issued Apr. 7, 1987, Scott, Jr. shows a decontamination chamber in which clothing is supported while it is sprayed by a plurality of nozzles located within the chamber.

In U.S. Pat. No. 3,868,835 issued Mar. 4, 1975, Todd-Reeve shows a washing machine having a compartment within which clothes are hung for washing, rinsing and drying. The clothes hang from an ordinary coat hanger and are sprayed by a system of nozzles within the chamber. Drying of the clothes is accomplished by a fan.

In U.S. Pat. No. 3,166,923 issued Jan. 26, 1965, Zacks shows a chamber in which articles to be dry cleaned are hung on an ordinary coat hanger and are subjected to cleaning fluid in vapor form.

In U.S. Pat. No. 2,699,661 issued Jan. 18, 1955, Olson shows a chamber in which articles of clothing are hung on an ordinary coat hanger and are subjected to a spray of water from selected nozzles.

All of these cleaning machines include a chamber and other apparatus that would ordinarily be installed in a building and used by a commercial cleaning establishment.

In contrast, the wetsuit washer of the present invention is much lighter in weight and can be used indoors over a bath tub, or outdoors in a yard or garden.

SUMMARY OF THE INVENTION

In accordance with the present invention, there is provided a very specialized type of coat hanger having a top cross arm and one or more lower cross arms. The wetsuit is hung on the uppermost one of the lower cross arms. Both the top cross arm and the lower cross arms are hollow and have a number of perforations from which water is sprayed on both the inside and outside of the garment.

A shroud of a water-resistant fabric is placed over the top cross arm and the wetsuit to confine the spray. Water is supplied to the specialized coat hanger through a garden hose, and the device includes provision for adding a washing compound and/or a conditioning compound to the water. The specialized coat hanger of the present invention may also be used to support the wetsuit during drying, transportation, and storage.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a front elevational view of a preferred embodiment of the wetsuit washer of the present invention;

FIG. 2 is a side elevational cross sectional view in the direction 2—2 indicated in FIG. 1;

FIG. 3 is a side elevational cross sectional view in the direction 3—3 indicated in FIG. 1.

FIG. 4 is a diagrammatic front elevational view of the embodiment of FIG. 1 showing the spray pattern it produces;

DETAILED DESCRIPTION OF THE PREFERRED EMBODIMENT

Figure 5:
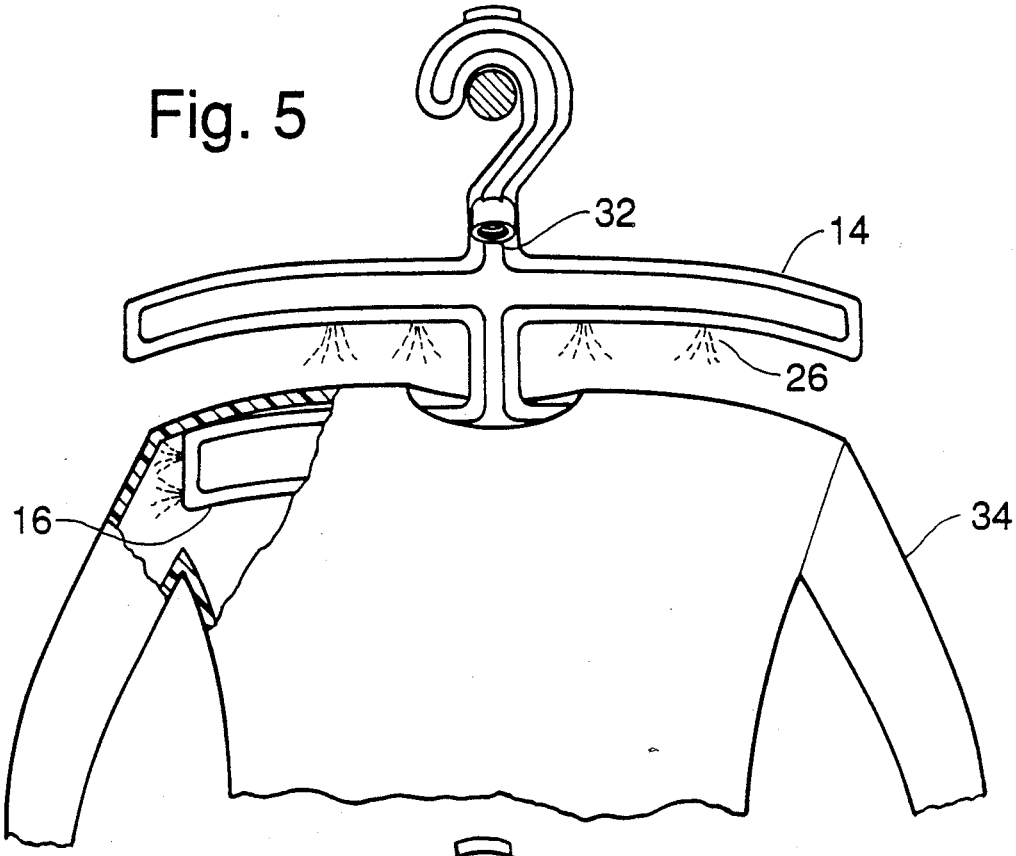
FIG. 5 is a diagrammatic front elevational view showing a wetsuit hanging on the wetsuit washer of FIG. 1.

As shown in FIG. 1, the wetsuit washer includes a vertically-extending support member 12 on which the weight of the wetsuit is supported during the washing process. Extending horizontally from the support member 12 are a top cross arm 14 and a lower cross arm 16. In the preferred embodiment, the support member 12, the top cross arm 14 and the lower cross arm 16 all lie in the same plane.

The support member 12 includes a vertically-extending passage 18 and a crook-shaped upper portion 20 that is used for hanging the washer on a pole 22 or from a clothes line, a chain, or a tree branch. The top cross arm 14 includes a horizontally extending passage 24 that communicates with the vertically-extending passage 18 of the support member 12. The top cross arm 14 also includes downwardly-directed ducts 26 that connect the horizontally-extending passage 24 with the space immediately below the top cross arm 14.

The lower cross arm 16 includes a horizontally-extending passage 28 and a number of ducts 30 that connect the horizontally-extending passage 28 to the space immediately surrounding the lower cross arm 16.

In an alternate embodiment, the support member 12 extends further downward and additional lower cross arms, similarly to the cross arm 16 extend from it.

In the preferred embodiment, a hose bibb 32 is provided to permit a source of pressurized water, such as a garden hose, to be connected to the vertically-extending passage 18.

In the preferred embodiment a slidable cover 40 is provided for selectively opening and closing a port at the top of the crook-shaped upper portion 20. Cleaning and conditioning additives may be introduced through this port to the vertically-extending passage 18. A baffle is provided within the passage 18 between the port and the hose bibb 32. The baffle spans almost the entire passage so as to slow the rate of mixing of the cleaning or conditioning compound with the water entering through the hose bibb 32.

Figure 6:
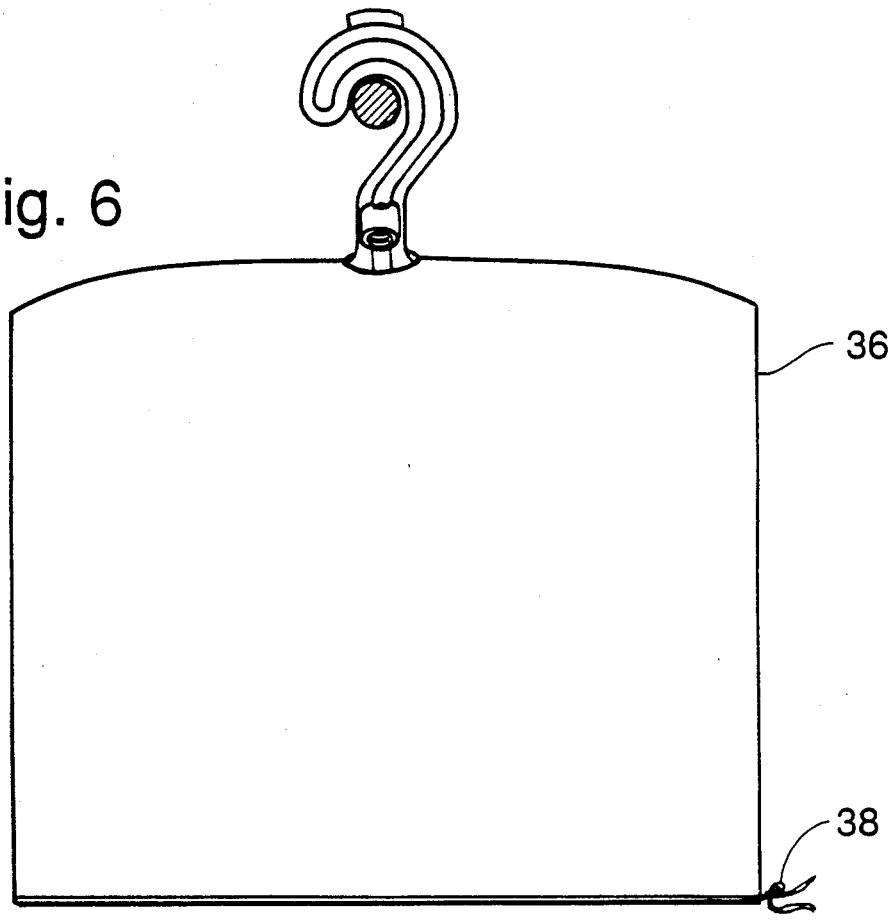
FIG. 6 is a diagrammatic front elevational view showing the wetsuit washer of FIG. 1 in use; and, FIG. 7 is a side elevational view of the embodiment of FIG. 1.

In operation, the wetsuit is hung on the lower cross arm 16. If there are more than one lower cross arms, the wetsuit is hung on the uppermost one of them. This leaves the top cross arm 14 extending over the shoulders of the wetsuit and the lower cross arms inside the wetsuit. As water is supplied to the washer, it passes through the vertically extending passage 18 and into the passages 24 and 28 in the cross arms, from which it is sprayed under pressure through the ducts 26 and 30. Since the spraying action is quite forceful, there is considerable splattering of the sprayed liquid from the wetsuit. To confine this splattering, a shroud 36 is provided which covers the top cross arm 14 as well as the wetsuit. In the preferred embodiment, the shroud is snugly drawn against the wetsuit by the drawstring 38 located at the lower edge of the shroud 36, as shown in FIG. 6.

Thus, there has been described a wetsuit washing device that can be left unattended while it washes or conditions or rinses a wetsuit. Thereafter, the wetsuit may be left hanging on the washer to dry. After the wetsuit is dry, it may be left on the wetsuit washer during storage and transportation.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A device for use in washing a wetsuit or similar article, comprising in combination:

a support member extending vertically and enclosing a vertically-extending passage;

a top cross arm extending horizontally from said support member and enclosing a horizontally-extending passage that communicates with the vertically-extending passage of said support member, said top cross arm including downwardly-directed ducts connecting its horizontally extending passage with the space below said top cross arm;

a lower cross arm extending horizontally from said support member and enclosing a horizontally-extending passage that communicates with the vertically-extending passage of said support member; said lower cross arm including ducts connecting its horizontally-extending passage with the space surrounding said lower cross arm.

2. The device of claim 1 wherein said support member further comprises in combination:

means for connecting a source of liquid under pressure to the vertically-extending passage of said support member.

3. The device of claim 2 wherein said means include a hose bibb.

4. The device of claim 2 wherein said means include a quick-disconnect fitting.

5. The device of claim 1 wherein said support member further comprises in combination:

means for suspending the device from a support.

6. The device of claim 1 wherein said support member further includes a crook-shaped upper portion for suspending the device from a support.

7. The device of claim 1 further comprising in combination a shroud supported by said top cross arm for covering a wetsuit that is being washed, to confine the spray produced by said top cross arm.

8. The device of claim 1 wherein said support member further comprises in combination:

means for introducing an additive to the vertically-extending passage in said support member.

* * * * *